US011736842B2

(12) United States Patent
Bothe

(10) Patent No.: US 11,736,842 B2
(45) Date of Patent: Aug. 22, 2023

(54) SPEAKER HORN WITH ROTATABLE RADIATION CHARACTERISTIC, SPEAKER ARRANGEMENT AND SPEAKER BOX

(71) Applicant: d&b audiotechnik GmbH & Co. KG, Backnang (DE)

(72) Inventor: Frank Bothe, Backnang (DE)

(73) Assignee: d&b audiotechnik GmbH & Co. KG, Backnang (DE)

( * ) Notice: Subject to any disclaimer, the term of this patent is extended or adjusted under 35 U.S.C. 154(b) by 0 days.

(21) Appl. No.: 17/678,535

(22) Filed: Feb. 23, 2022

(65) Prior Publication Data

US 2022/0279257 A1 Sep. 1, 2022

(30) Foreign Application Priority Data

Mar. 1, 2021 (DE) ..... 10 2021 104 847.8

(51) Int. Cl.
*H04R 1/02* (2006.01)
*H04R 1/30* (2006.01)

(52) U.S. Cl.
CPC ..... *H04R 1/025* (2013.01); *H04R 1/30* (2013.01)

(58) Field of Classification Search
CPC ..... H04R 1/025; H04R 1/30
USPC ..... 381/386
See application file for complete search history.

(56) References Cited

U.S. PATENT DOCUMENTS 3,022,853 A * 2/1962 Santi ..... G10K 11/355 381/62
7,275,621 B1 * 10/2007 Delgado, Jr. ..... H04R 1/403 181/150
2014/0262600 A1 * 9/2014 Hughes, II ..... H04R 1/403 181/296

FOREIGN PATENT DOCUMENTS

DE 10230409 C1 10/2003
JP 2006229803 A 8/2006

* cited by examiner

*Primary Examiner* — Sean H Nguyen
(74) *Attorney, Agent, or Firm* — Cooper Legal Group, LLC

(57) ABSTRACT

A speaker horn with rotatable radiation characteristics has a base body in the form of an opening funnel with a rotationally symmetrical inner wall in the radiation area and an insert mounted so that it can rotate relative to the base body. The insert covers part of the rotationally symmetrical inner wall acoustically and causes the rotatable radiation characteristic of the speaker horn.

21 Claims, 3 Drawing Sheets

SPEAKER HORN WITH ROTATABLE RADIATION CHARACTERISTIC, SPEAKER ARRANGEMENT AND SPEAKER BOX

RELATED APPLICATIONS

The present disclosure claims priority to German Patent Application 102021104847.8, filed on Mar. 1, 2021, which is incorporated herein by reference.

TECHNICAL FIELD

This disclosure relates to the field of speakers, speaker horns and speaker boxes and in particular to techniques of changing their radiation characteristics.

BACKGROUND

Speaker systems typically have different radiation characteristics in the horizontal and vertical planes. This is generally used specifically to provide uniform coverage of audience areas of different geometry.

A common measure for achieving a defined radiation characteristic is the use of a horn for sound guidance. So-called "constant directivity" horns are often used, which provide a radiation angle that is as constant as possible over the frequency in both the horizontal and vertical planes, e.g. 90° horizontally and 50° vertically.

Speaker arrangements are usually designed as multi-driver systems. In the high-frequency range, such horns are often used in combination with corresponding high-frequency speakers (tweeter). In the frequency ranges below, they are often dispensed with for reasons of space, and direct-radiating diaphragm speaker drivers are used.

SUMMARY

An object of the disclosure can be seen in creating a speaker horn which provides a radiation characteristic which can be varied in a horizontal and vertical plane in a simple manner. Furthermore, the disclosure aims at providing a speaker arrangement comprising a speaker driver and a speaker horn as well as a speaker box comprising such a speaker arrangement.

Accordingly, a speaker horn with rotatable radiation characteristic can include a base body in the form of an opening funnel with a rotationally symmetrical inner wall in the radiation area. The speaker horn can also include an insert which is rotatably mounted relative to the base body and acoustically covers part of the rotationally symmetrical inner wall, thus producing the rotatable radiation characteristic of the speaker horn.

BRIEF DESCRIPTION OF THE DRAWINGS

Embodiments are explained below by means of examples with reference to the drawings. Identical reference signs indicate identical or corresponding parts.

DETAILED DESCRIPTION

Figure 1A:
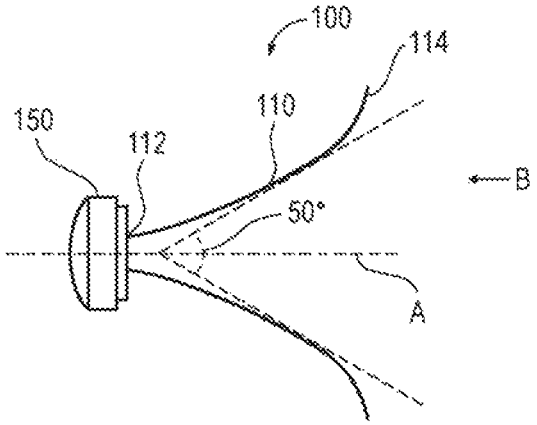
FIG. 1A is a schematic longitudinal sectional view of the base body of a speaker horn in the sound path behind a speaker driver.

Due to the changeability of the radiation characteristic (radiation pattern) by rotation of the insert, it is achieved that the base body of the horn can be accommodated in a speaker arrangement or in a speaker box in a rotationally fixed manner and yet the sound guidance in the speaker horn can be rotated by the rotatably mounted insert (i.e. by sound guidance surfaces of the rotatably mounted insert).

In other words, the rotational angle variability of the insert makes it possible to change the vertical and horizontal radiation angle of the speaker horn without having to dismantle, rotate or otherwise structurally modify the base body of the speaker horn itself. In particular, this allows the base body of the speaker horn to be firmly connected to a speaker and/or an enclosure or enclosure part of a speaker box, and still provide a directionally variable radiation characteristic. For example, the enclosure part can be a sound baffle inserted into the speaker box enclosure.

The insert may define the contour of the sound guide in the speaker horn in a first radiation plane and the base body can define the contour of the sound guide in a second radiation plane perpendicular to the first radiation plane. The rotatable radiation characteristic (or pattern) is obtained by rotating the rotatably mounted insert.

The insert may be made of a plurality of parts (e.g. two parts), whereby the parts of the insert can be connected to each other in a rotationally fixed manner.

The insert may include two opposing tongue-shaped sound guiding surfaces. These tongue-shaped sound guiding surfaces cover the inner wall of the base body in the radiation area for example at two opposite inner wall areas, so that in the plane defined by the tongue-shaped sound guiding surfaces a modified radiation characteristic (radiation pattern) is achieved compared to the inner wall of the base body. In free areas between the tongue-shaped sound guiding surfaces, the inner wall of the base body is not covered in the radiation area, so that in the plane defined by the free areas, the radiation characteristic is determined by the base body.

A simple implementation of the rotatable mounting of the insert is that the insert—for example the several parts of the insert—is attached to the base body of the speaker horn via a pivot bearing. However, it is also conceivable, for example, that the rotary mounting is made on a speaker driver that provides the input sound for the speaker horn.

The rotatable insert can be interchangeably attached to the base body. This allows rotatable inserts with different geometries to be used. In addition, it is possible for the user to exchange inserts.

In an alternative embodiment, the insert is not interchangeably attached to the base body. In this case, the rotationally variable radiation characteristic is fixedly determined by the shape of the base body and the shape of the insert.

For easier adjustment of the angle of rotation, the insert can be equipped with an operating lever via which the angle of rotation can be adjusted manually.

FIG. 1A shows a schematic cross-sectional view of the base body 110 of a speaker horn 100. FIG. 1A further shows a speaker driver 150 that can be connected to a sound inlet end 112 of the base body 110.

The base body 110 of the speaker horn 100 is designed in the form of an opening funnel with a rotationally symmetrical inner wall in the radiation area. For example, the base body 110 may have a substantially circular contour in cross-section over a sound exit side section or over its entire axial extent, whereby the radii of the circles may increase steadily in the sound exit direction.

The rotational symmetry may, e.g., be a cylindrical symmetry, i.e. when rotated through any angle about the axis of symmetry A, the rotationally symmetrical inner wall in the radiation area of the base body 110 maps on itself. When the rotational symmetry is, e.g., a cylindrical symmetry, the radiation characteristic of the base body of the speaker horn specified by the shape of the inner wall in the radiation area is essentially the same in all radiation planes, i.e., for example, the horizontal radiation and the vertical radiation cover an essentially identical angular range.

The opening funnel shape may increase steadily from a sound inlet end 112 to a sound exit end 114 of the speaker horn. However, it is also possible that, for example, at the sound inlet end 112, there is initially a section with a constant diameter or even a tapering diameter in the direction of sound propagation and the opening funnel shape only occurs in a section of the base body 110 located further on the sound exit side. Likewise, the rotationally symmetrical inner wall need not extend over the entire length of the base body 110. For example, the sound inlet end 112 may be implemented as a gap or arbitrarily shaped sound inlet channel, while the rotational symmetry of the inner wall is formed only further on the sound exit side in the course of the base body 110 of the speaker horn 100, namely where the spatial radiation characteristic of the speaker horn is influenced. Due to the opening funnel shape of the base body 110 of the speaker horn 100, the radiation angles of the speaker horn 100 are predetermined in the areas in which the inner wall of the base body 110 is not acoustically covered by the insert yet to be described.

Figure 1B:
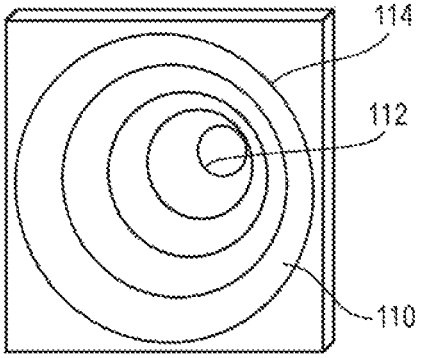
FIG. 1B is a schematic perspective view of the base body of the speaker horn from FIG. 1A, looking at the sound exit area.

FIG. 1B shows the inner wall of the base body 110 of the speaker horn 100 in perspective view from the viewing point B of FIG. 1A. The course of the inner wall of the base body 110 can be seen along concentric cross-sectional circles (which, however, do not appear concentric due to the oblique perspective view).

Figure 2A:
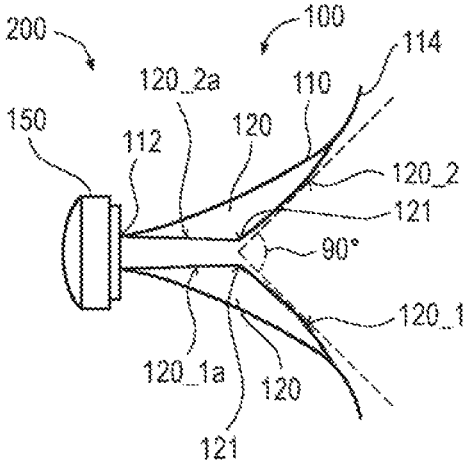
FIG. 2A is a schematic longitudinal sectional view of an example of a speaker horn with base body and integrated rotatable insert.

FIG. 2A shows the speaker horn 100 of FIGS. 1A and 1B with the base body 110 and an insert 120 rotatably mounted with respect to the base body 110. As can be seen in the perspective views of FIGS. 2B and 2C, the insert 120 is rotatable with respect to the base body 110 and acoustically covers part of the rotationally symmetrical inner wall of the base body 110. The areas of the inner wall of the base body 110 that are acoustically covered by the insert 120 can be changed by rotating the insert 120.

Figure 2B:
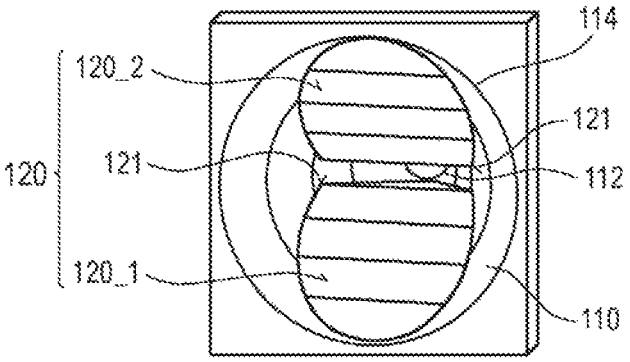
FIG. 2B is a schematic perspective view of an example of a speaker horn with base body and rotatably mounted insert looking at the sound exit area.
Figure 2C:
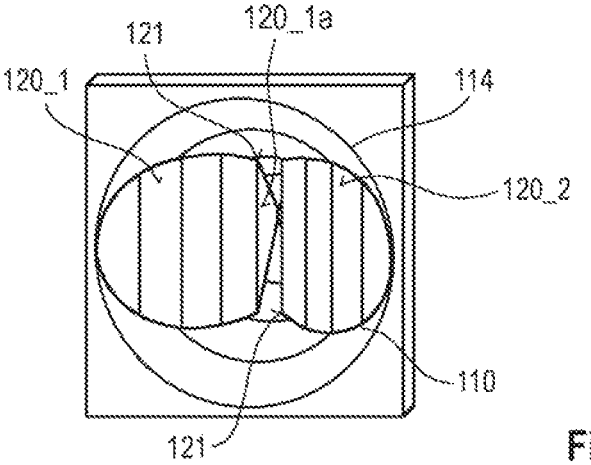
FIG. 2C is the illustration of FIG. 2B with the insert rotated by 90°.

For example, in the rotated position shown in FIGS. 2A and 2B, sound guiding surfaces 120_1, 120_2 of the insert 120 cover regions of the inner wall of the base body 110 along a vertical plane of the speaker horn 100, while in the 90° rotated position of the insert 120 shown in FIG. 2C, inner wall regions of the base body 110 along a horizontal extension of the speaker horn 100 are acoustically covered by the sound guiding surfaces 120_1, 120_2.

The insert 120 or more precisely its sound guiding surfaces 120_1, 120_2 have a sound guiding contour that differs from the contour of the inner wall of the base body 110 in the radiation area. That is, the radiation characteristic of the speaker horn in a first radiation plane (for example, the horizontal plane in FIGS. 2A and 2B) is predetermined by the contour of the base body and in a second radiation plane (for example, the vertical plane in FIGS. 2A and 2B) is predetermined by the contour of the insert (or, more precisely, the sound guiding surfaces 120_1, 120_2 of the insert 120). In this context, the contour of the insert 120 (or, more precisely, of the sound guiding surfaces 120_1, 120_2 thereof) may be rotationally symmetric in the sense that a 180° rotation causes the insert 120 to be imaged onto itself, but at other angles of rotation it is not (i.e., the insert 120 does not exhibit cylindrical symmetry).

In this way, a "Constant Directivity (CD)" speaker horn 100 with a "built-in" rotatable radiation characteristic can be provided. The (optional) CD characteristic of the speaker horn 100 is thereby generated both by the shaping of the base body 110 in the conical radiation area and by the shaping of the sound guiding surfaces 120_1, 120_2 of the insert 120.

The sound guiding surfaces 120_1, 120_2 of the insert 120 can be mechanically fixed to each other, for example a one-piece realization is possible. In this case, a rotation of the sound guiding surfaces 120_1, 120_2 always occurs together. In other cases, however, it is also possible to mount the sound guiding surfaces 120_1, 120_2 of the insert 120 separately so that they can rotate relative to the base body 110, so that the radiation characteristic can also be influenced in the off-axis direction.

For example, the insert 120 may be continuously rotated through at least 90°. Further, latching against unintended rotation may be provided in each of the positions shown in FIGS. 2B and 2C, for example.

In the example shown in FIGS. 1A to 2B, the base body 110 has a radiation angle of 50°, for example, while the insert 120 specifies a radiation angle of 90° as a result of corresponding shaping of the sound guiding surfaces 120_1, 120_2. In this example, the vertical radiation angle (FIGS. 2A-2B) or the horizontal radiation angle (FIG. 2C) can be extended from the radiation angle of, for example, 50° specified by the shaping of the base body 110 to the radiation angle of, for example, 90° specified by the shaping of the insert 120.

The insert 120 may, for example, be in the form of opposing tongue-shaped sound guiding surfaces 120_1, 120_2. Then, the tongue-shaped sound guiding surfaces 120_1, 120_2 may extend, for example, substantially over the entire length of the base body as shown in FIGS. 2A, 2B and 2C, i.e., for example, substantially from the sound inlet end 112 of the base body 110 to substantially the sound exit end 114 of the base body 110.

For example, the sound guiding surfaces 120_1, 120_2 in sections 120_1*a*, 120_2*a* on the sound inlet side can be formed as boundary surfaces of an upstream sound channel which guides the sound up to a kink 121 of the sound guiding surfaces 120_1, 120_2, which then determine the radiation characteristic of the insert 120 in the further course by a corresponding opening angle. In this example, the upstream sound channel is thus formed both by the sound inlet-side sections 120_1*a*, 120_2*a* of the sound guiding surfaces 120_1, 120_2 and by the inner wall of the base body 110 of the speaker horn 100. The larger the radiation angle, the further on the sound exit side the kink 121 of the insert 120 is located (i.e., the longer the upstream sound channel of the insert 120, compare FIGS. 2A and 3).

The kink 121 forms the diffraction gap of the speaker horn 100 with insert 120. The diffraction gap of the speaker horn 100 is thus determined by the shape of the insert 120. In other words, the diffraction gap of the speaker horn 100 is rotated by the insert 120 and—compared to the speaker horn 100 without insert 120 shown in FIG. 1A—displaced forward. In the direction of sound propagation behind the diffraction gap, the radiation characteristic (radiation pattern) is determined by the opposing tongue-shaped sound guiding surfaces 120_1, 120_2 and in the free areas between the tongue-shaped sound guiding surfaces 120_1, 120_2 by the uncovered inner wall of the base body 110.

A speaker arrangement includes a speaker driver and a speaker horn arranged in the sound path behind the speaker driver, with the speaker horn can be formed as described above. The insert may be attached either to the base body of the speaker horn, as described above, or to the speaker driver via a pivot bearing. In particular, it is also possible for the base body of the speaker horn to be mechanically fixed to a housing of the speaker driver, for example by forming the base body of the speaker horn and the housing of the speaker driver in one piece.

Figure 3:
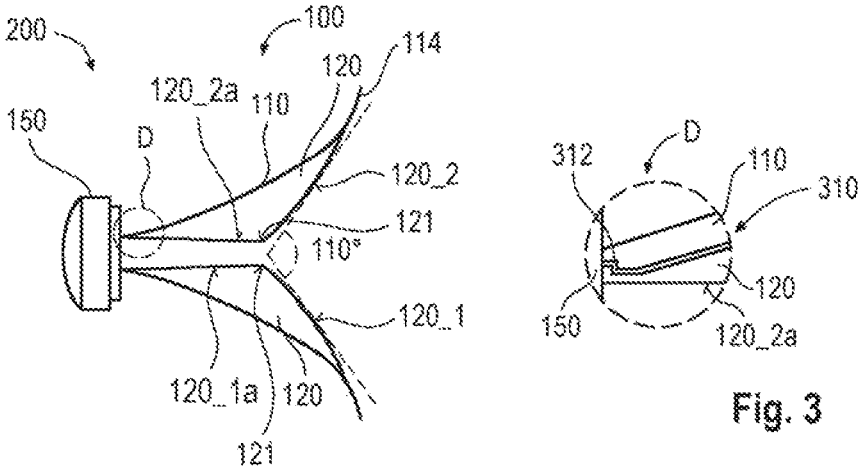
FIG. 3 is a schematic longitudinal sectional view of an example of a speaker horn with base body and rotatably mounted insert, which realizes a radiation angle different from FIG. 2A, as well as a detailed illustration of an example of a pivot bearing of the insert on the base body.

FIG. 3 shows an example of a speaker horn 100 that differs from the speaker horn 100 shown in FIGS. 2A to 2C only in that a wider coverage angle of, for example, 110° is provided by the insert 120.

It may be advantageous if the insert 120 is replaceably attached to the base body 110. However, it is also possible that a mechanically undetachable rotary connection or a rotary connection not intended for the exchange of inserts 120 is present between the base body 110 and the insert 120.

Detail D in FIG. 3 shows an exemplary pivot bearing 310, by means of which the insert 120 can be attached to the base body 110 in a rotationally adjustable manner. In the example shown here, the pivot bearing 310 can include, for example, an annular groove 312 present on the base body 110, into which an annular flange of the insert 120 projects, for example in the region of the sound inlet-side section 120_2*a* of the sound guiding surface 120_2.

The pivot bearing 310 may be designed such that rotation of the insert 120 relative to the base body 110 can be performed by hand alone, without tools, but requires overcoming either a detent or a substantial frictional force. The relatively high friction between said parts prevents the rotational position of the insert 120 from being automatically changed in an undesirable manner, for example, by vibration. Furthermore, an operating lever (not shown) may be provided on the insert 120 by means of which the rotation of the insert 120 may be performed manually. For example, the operating lever may be located on the front side of one or both sound guiding surfaces 120_1, 120_2, so that the rotation of the insert 120 can be performed in a simple manner by the user.

In all examples, the base body 110 of the speaker horn 100 and/or the insert 120 of the speaker horn 100 may be made of a plastic material or may be made of a metallic material (e.g., die-cast aluminum).

FIGS. 2A to 3 further show examples of a speaker arrangement 200 comprising the speaker driver 150 and the speaker horn 100 with insert 120 arranged in the sound path behind the speaker driver 150. In particular, the speaker driver 150 may be a high-frequency or mid-high-frequency driver, although drivers for lower frequencies are generally also possible, in which case correspondingly larger horn dimensions are required.

The speaker horn 100 may be directly connected to the speaker driver 150 or, in a manner not shown, a sound channel may be provided between the speaker driver 150 and the speaker horn 100 through which the output sound from the speaker driver 150 is directed to the sound inlet end 112 of the base body 110 of the speaker horn 100.

A speaker box includes a speaker box enclosure and a speaker arrangement as described above. The base body of the speaker horn can be mechanically fixedly connected to the speaker box enclosure or an enclosure part of the speaker box enclosure and, in particular, be formed in one piece with the speaker box enclosure or the enclosure part.

Figure 4:
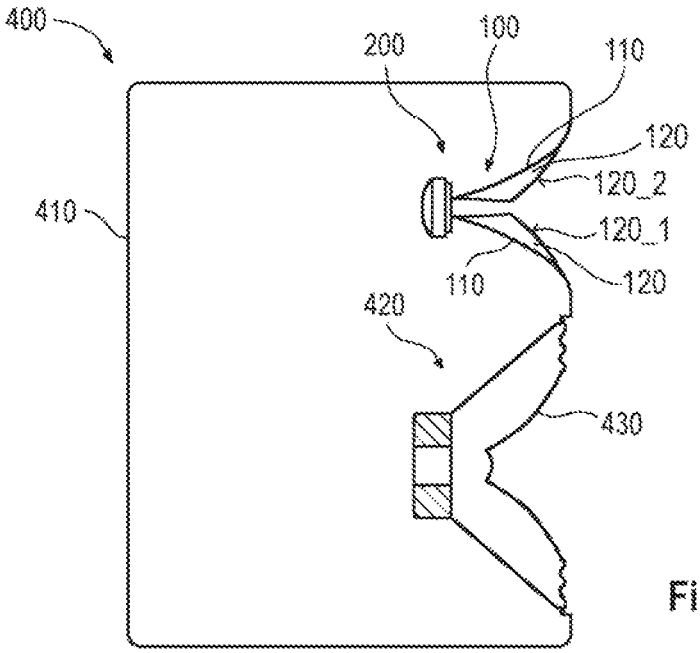
FIG. 4 is an example of a biaxial speaker box including a speaker arrangement comprising a speaker horn according to the disclosure herein.

FIG. 4 shows an example of a speaker box 400 in which a speaker arrangement 200 is installed. The speaker box 400 has a speaker box enclosure 410 formed with a sound exit opening for the speaker arrangement 200.

For example, the base body 110 of the speaker horn 100 may be mechanically fixed to the speaker box enclosure 410. This is possible because the rotation of the radiation characteristic of the speaker arrangement 200 is accomplished by the rotation of the insert 120 and not by a rotation of the base body 110. In particular, it may also be provided, for example, that the base body 110 of the speaker horn 100 is integrally formed with the speaker box enclosure 410 or an enclosure part of the speaker box enclosure 410, for example by the base body 110 being integrally molded with the speaker box enclosure 410 (which is made of plastic, for example) or by being an integral part of a sound baffle (not shown—made of plastic, for example) that is inserted into a speaker box enclosure 410, which in turn may be made of plastic, for example, or may be made of another material such as wood.

The speaker box 400 shown in FIG. 4 may, for example, be designed as a multi-driver system, i.e. additionally equipped with a low-frequency speaker 420. In the example shown in FIG. 4, the system is a biaxial multi-driver system in which the tweeter or mid-treble speaker arrangement 200 is arranged laterally adjacent to the low-frequency speaker 420.

Figure 5:
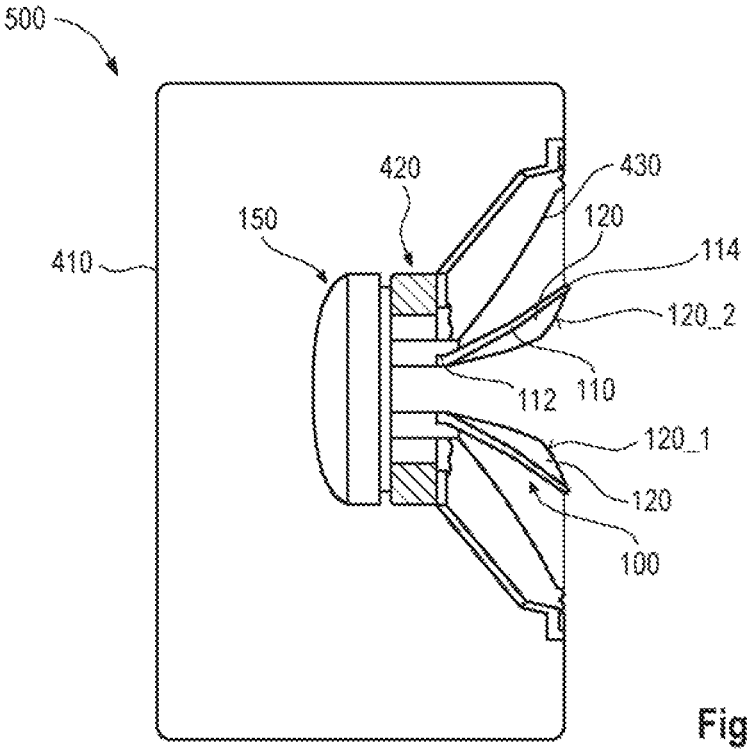
FIG. 5 is an example of a coaxial speaker box including a speaker arrangement comprising a speaker horn according to the disclosure herein.

Alternatively, as shown in FIG. 5, a coaxial multi-driver system may be equipped with a speaker arrangement 200 as described above, for example. In such a speaker box 500, the speaker driver 150 and a driver of the low-frequency speaker 420 are arranged coaxially one behind the other, the driver of the low-frequency speaker 420 driving a diaphragm 430 which is arranged radially outside the base body 110 of the speaker horn 100. The speaker horn 100 may be formed as described above.

Also in a coaxial multi-driver system as exemplarily shown in FIG. 5, it is possible that the base body 110 of the speaker horn 100 is firmly connected to the speaker box enclosure 410 and in particular, for example, can be integrally (one-piece) formed therewith.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A speaker horn with rotatable radiation characteristic, comprising:

a base body in a form of an opening funnel with a rotationally symmetrical inner wall in a radiation area, and an insert which is rotatably mounted relative to the base body about an axis of rotational symmetry of the rotationally symmetrical inner wall, the insert acoustically covering part of the rotationally symmetrical inner wall and producing the rotatable radiation characteristic of the speaker horn.

2. The speaker horn of claim 1, wherein the insert specifies a contour of sound guide in the speaker horn in a first radiation plane and the base body specifies a contour of sound guide in a second radiation plane perpendicular to the first radiation plane.

3. The speaker horn of claim 1, wherein the insert is formed in a plurality of parts.

4. The speaker horn of claim 1, wherein the insert comprises two opposing tongue-shaped sound guiding surfaces.

5. The speaker horn of claim 4, wherein the two opposing tongue-shaped sound guiding surfaces extend substantially an entire length of the base body.

6. The speaker horn of claim 1, wherein the insert is attached to the base body via a pivot bearing.

7. The speaker horn of claim 1, wherein the insert is replaceably attached to the base body.

8. The speaker horn of claim 1, wherein the insert is non-interchangeably attached to the base body.

9. The speaker horn of claim 1, wherein the insert is provided with an operating lever by means of which a rotational position of the insert can be varied.

10. A speaker arrangement comprising a speaker driver and the speaker horn of claim 1, wherein the speaker horn is arranged in a sound path behind the speaker driver.

11. The speaker arrangement of claim 10, wherein the base body of the speaker horn is mechanically fixed to a housing of the speaker driver.

12. The speaker arrangement of claim 11, wherein the base body of the speaker horn and the housing of the speaker driver are integrally formed.

13. The speaker arrangement of claim 10, wherein the speaker driver is a high-frequency or mid-high frequency driver.

14. A speaker box comprising a speaker box enclosure and the speaker arrangement of claim 10.

15. The speaker box of claim 14, wherein the base body of the speaker horn is mechanically fixedly connected to the speaker box enclosure or an enclosure part of the speaker box enclosure.

16. The speaker box of claim 14, wherein the base body of the speaker horn and the speaker box enclosure or an enclosure part of the speaker box enclosure are integrally formed.

17. A speaker horn with rotatable radiation characteristic, comprising:

a base body in a form of an opening funnel with a rotationally symmetrical inner wall in a radiation area, and an insert which is rotatably mounted relative to the base body, the insert acoustically covering part of the rotationally symmetrical inner wall and producing the rotatable radiation characteristic of the speaker horn, wherein the insert specifies a contour of sound guide in the speaker horn in a first radiation plane and the base body specifies a contour of sound guide in a second radiation plane perpendicular to the first radiation plane.

18. A speaker horn with rotatable radiation characteristic, comprising:

a base body in a form of an opening funnel with a rotationally symmetrical inner wall in a radiation area, and an insert which is rotatably mounted relative to the base body, the insert acoustically covering part of the rotationally symmetrical inner wall and producing the rotatable radiation characteristic of the speaker horn, wherein the insert comprises two opposing tongue-shaped sound guiding surfaces.

19. A speaker horn with rotatable radiation characteristic, comprising:

a base body in a form of an opening funnel with a rotationally symmetrical inner wall in a radiation area, and an insert which is rotatably mounted relative to the base body, the insert acoustically covering part of the rotationally symmetrical inner wall and producing the rotatable radiation characteristic of the speaker horn, wherein the insert is attached to the base body via a pivot bearing.

20. A speaker horn with rotatable radiation characteristic, comprising:

a base body in a form of an opening funnel with a rotationally symmetrical inner wall in a radiation area, and an insert which is rotatably mounted relative to the base body, the insert acoustically covering part of the rotationally symmetrical inner wall and producing the rotatable radiation characteristic of the speaker horn, wherein the insert is replaceably attached to the base body.

21. A speaker horn with rotatable radiation characteristic, comprising:

a base body in a form of an opening funnel with a rotationally symmetrical inner wall in a radiation area, and an insert which is rotatably mounted relative to the base body, the insert acoustically covering part of the rotationally symmetrical inner wall and producing the rotatable radiation characteristic of the speaker horn, wherein the insert is non-interchangeably attached to the base body.

* * * * *